US009175867B2

(12) United States Patent
Grohman

(10) Patent No.: US 9,175,867 B2
(45) Date of Patent: Nov. 3, 2015

(54) PEAK LOAD OPTIMIZATION USING COMMUNICATING HVAC SYSTEMS

(75) Inventor: Wojciech Grohman, Little Elm, TX (US)

(73) Assignee: Lennox Industries Inc., Richardson, TX (US)

( * ) Notice: Subject to any disclaimer, the term of this patent is extended or adjusted under 35 U.S.C. 154(b) by 431 days.

(21) Appl. No.: 12/857,685

(22) Filed: Aug. 17, 2010

(65) Prior Publication Data

US 2012/0046797 A1 Feb. 23, 2012

(51) Int. Cl.

| | |
|---|---|
| ***G06F 1/32*** | (2006.01) |
| ***H02J 3/14*** | (2006.01) |
| ***F24F 11/00*** | (2006.01) |

(52) U.S. Cl.

CPC ..... *F24F 11/0009* (2013.01); *F24F 2011/0046* (2013.01); *Y10T 307/484* (2015.04)

(58) Field of Classification Search

CPC ..... G06F 1/32; H02J 3/14
USPC ..... 700/296, 277; 307/41; 236/49.3
See application file for complete search history.

(56) References Cited

U.S. PATENT DOCUMENTS

| | | | | |
|---|---|---|---|---|
| 4,711,394 | A * | 12/1987 | Samuel | 236/49.3 |
| 5,244,146 | A * | 9/1993 | Jefferson et al. | 236/11 |
| 7,809,472 | B1 * | 10/2010 | Silva et al. | 700/277 |
| 8,116,911 | B2 * | 2/2012 | Bailey et al. | 700/276 |
| 2009/0062970 | A1 * | 3/2009 | Forbes et al. | 700/295 |

* cited by examiner

*Primary Examiner* — Tejal Gami
(74) *Attorney, Agent, or Firm* — Baker Botts L.L.P.

(57) ABSTRACT

An HVAC system includes a first and a second electric motor. A load manager is coupled to the first electric motor. The load manager is configured to prevent the first electric motor from operating simultaneously with said second electric motor.

26 Claims, 7 Drawing Sheets

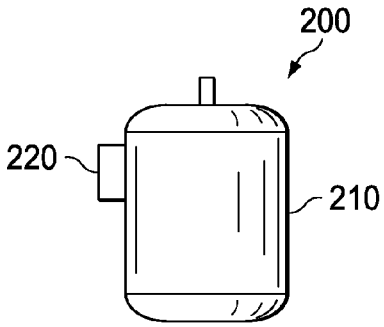
FIG. 2
FIG. 3
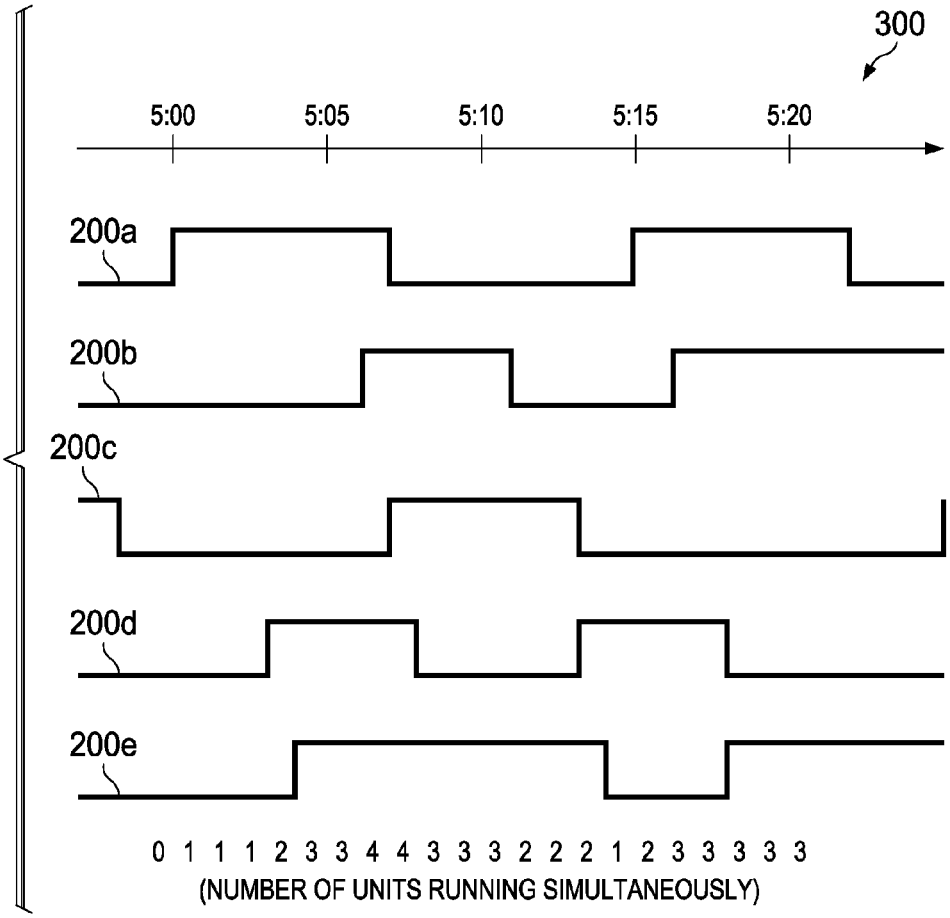

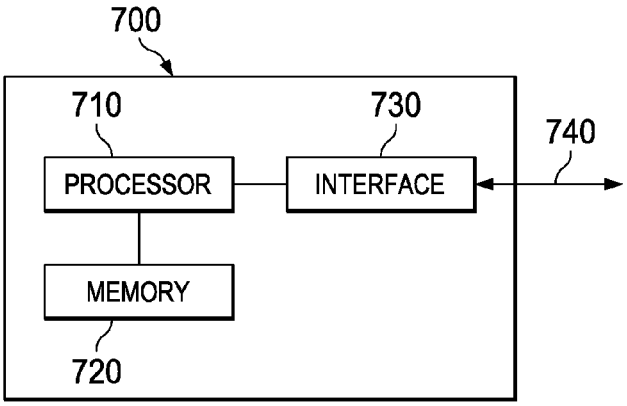
FIG. 7
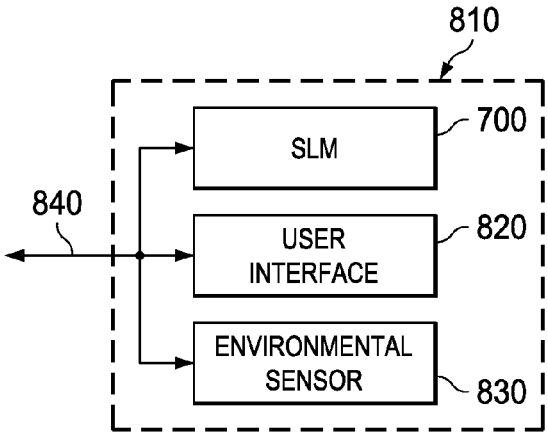
FIG. 8
FIG. 9
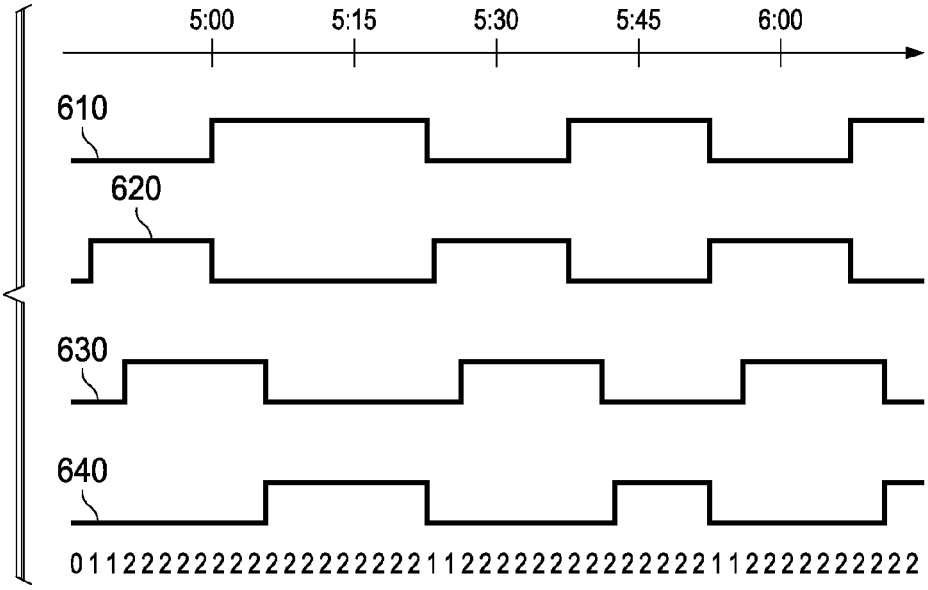

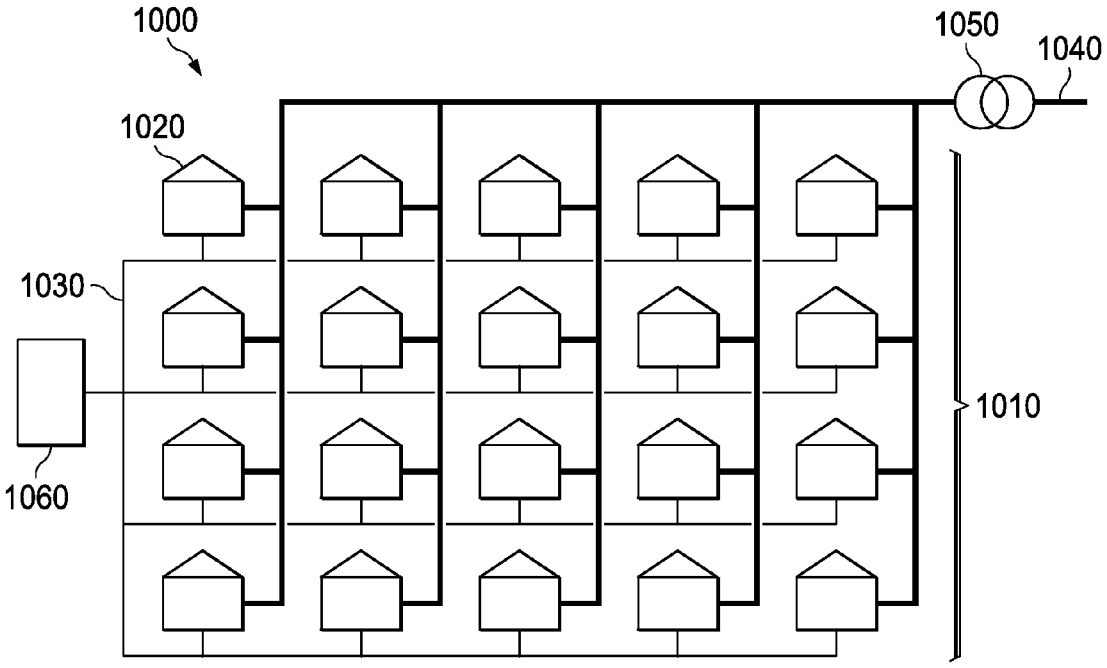
FIG. 10
FIG. 11A
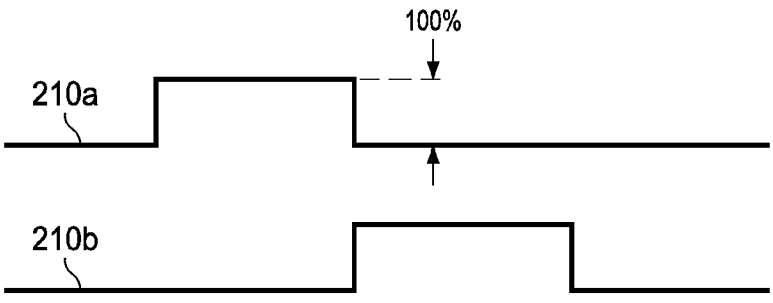
FIG. 11B
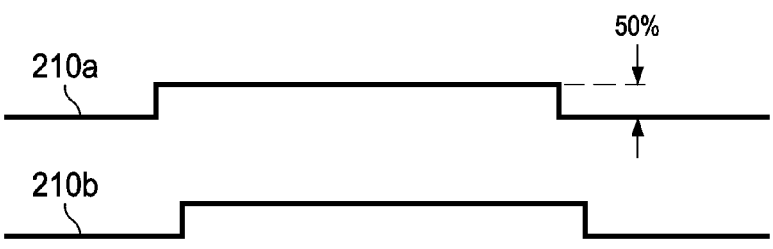

PEAK LOAD OPTIMIZATION USING COMMUNICATING HVAC SYSTEMS

TECHNICAL FIELD

This application is directed, in general, to HVAC systems, and, more specifically, to managing power consumed thereby.

BACKGROUND

Power demands imposed on an electrical distribution grid by heating ventilation and air conditioning (HVAC) equipment may be substantial. For example, a single HVAC system, including a compressor, outdoor unit fan and indoor unit fan may consume 10 KW or more. During times of peak demand, multiple HVAC systems may impose a load high enough to require the electric utility to limit power distribution, resulting in selective disabling of some HVAC systems, brownouts or even blackouts.

Electric utilities typically seek to avoid such undesirable events by designing the power generation and distribution system to accommodate peak loads. While such a strategy may be effective in many cases, outlier events may overwhelm the excess capacity. Even without such events, providing excess capacity is costly. Accordingly, additional methods are needed to reduce peak demands on power grids imposed by HVAC systems.

SUMMARY

One aspect provides an HVAC system that includes a first and a second electric motor. A load manager is coupled to the first electric motor. The load manager is configured to prevent the electric motor from operating simultaneously with the second electric motor.

Another aspect provides an HVAC load manager. The load manager includes a memory, a communications interface and a processor. The memory is configured to store controller instructions. The communications interface is adapted to transmit motor command signals to a first and a second electric motor. The processor is configured to issue the motor command signals in response to the controller instructions. The command signals are configured to prevent the first and second electric motors from simultaneously operating.

Yet another aspect is a method of manufacturing an HVAC load manager. The method includes configuring a memory to store controller instructions. A communications interface is adapted to transmit motor command signals to a first and a second electric motor. A processor is configured to issue the motor command signals in response to the controller instructions. The command signals are configured to prevent the first and second electric motors from simultaneously operating.

Still another embodiment is an HVAC motor assembly. The motor assembly includes an electric motor and a load manager. The load manager is configured to enable operation of the electric motor based on an identification datum of the electric motor.

BRIEF DESCRIPTION

Reference is now made to the following descriptions taken in conjunction with the accompanying drawings, in which:

FIG. 2 illustrates a motor assembly, illustratively including a motor and a load manager (LM);

FIG. 3 illustrates an illustrative timing diagram of several HVAC systems operating such that no two HVAC systems simultaneously start operating;

Figure 5:
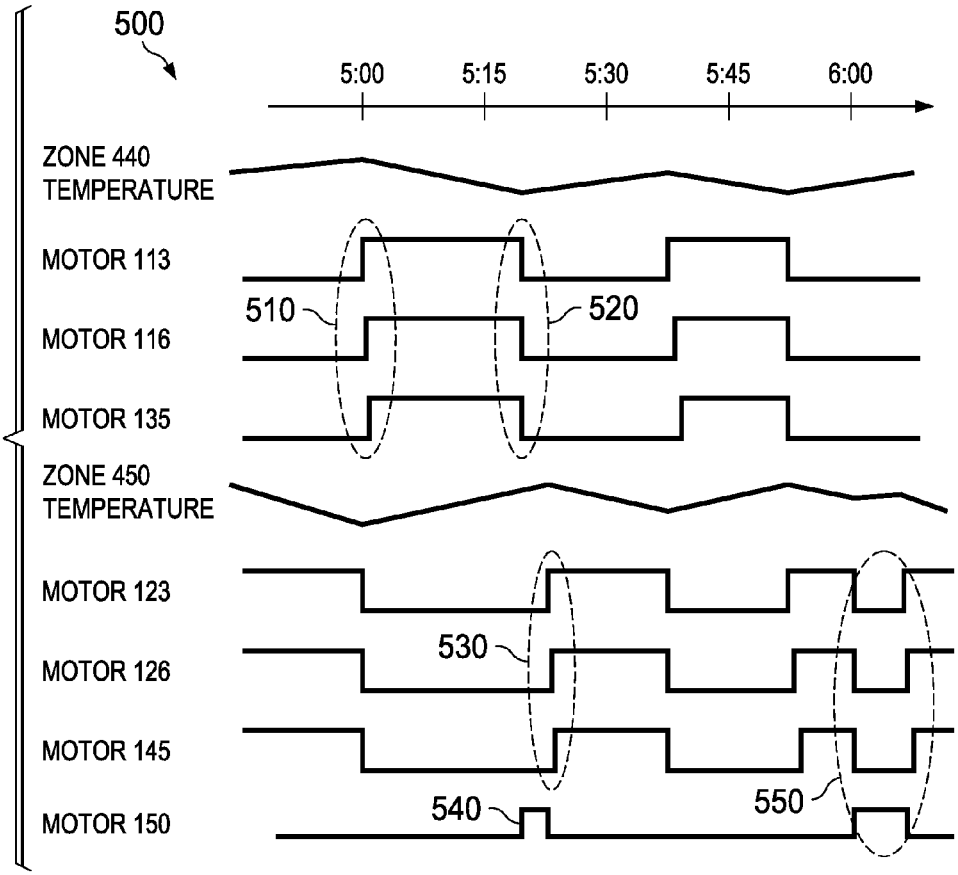
Figure 6:
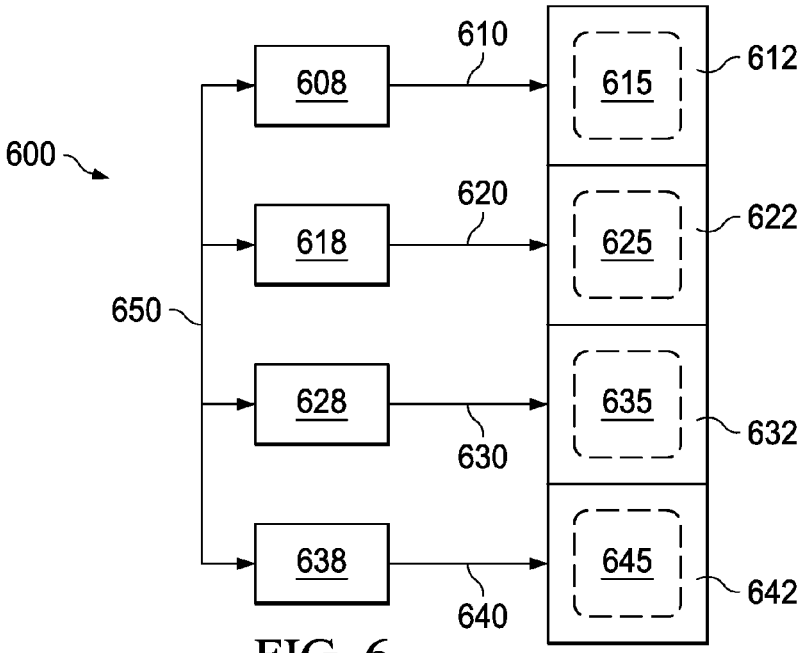
Figure 12A:
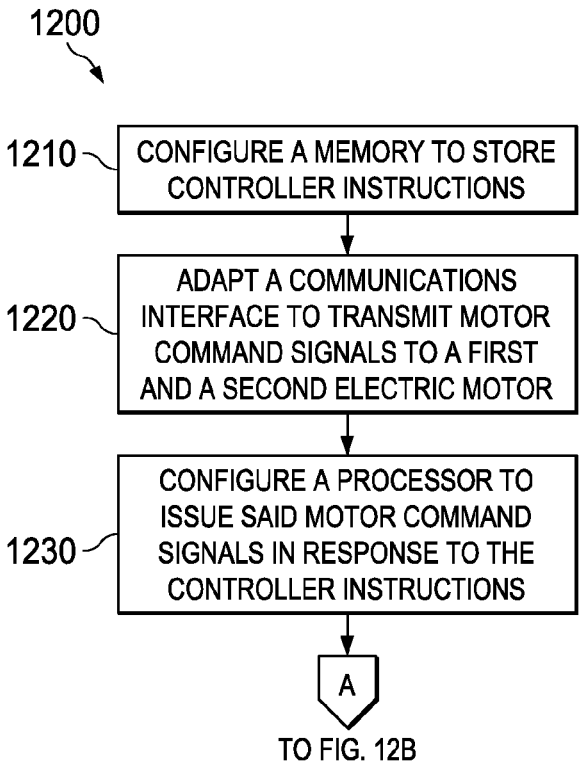
Figure 12B:
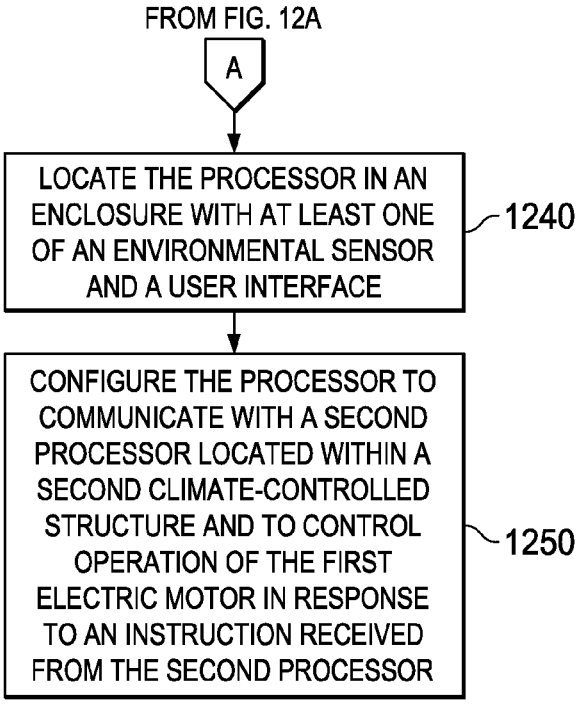

FIG. 5 presents an illustrative timing diagram of several HVAC systems operating, e.g. to prevent control zones from simultaneously operating;

FIG. 6 presents an illustrative cooling system;

FIG. 7 presents an illustrative load manager;

FIG. 8 illustrates an embodiment in which a system load manager is located in an enclosure with a user interface and an environmental sensor;

FIG. 9 presents an illustrative timing diagram showing aspects of various embodiments of motor control in which only two motors may simultaneously operate;

FIG. 10 illustrates a cluster of climate-controlled structures;

FIGS. 11A and 11B illustrate motor command signals at 100% of a maximum capacity, and at less than 100% of the maximum capacity; and FIGS. 12A and 12B illustrate a method of the disclosure of manufacturing a load manager.

DETAILED DESCRIPTION

Embodiments described herein reflect the recognition that the electrical load on a power distribution network that feeds multiple electrical loads, such as those imposed by an HVAC system, may be reduced by properly managing the operation of the loads. In some embodiments the total number of loads operating simultaneously is limited, while managing the loads to ensure equitable distribution of capacity to the various functions served by the loads. In other embodiments some loads are prevented from starting simultaneously to avoid multiple inrush current spikes in the power network. Various embodiments have particular utility in controlling multiple HVAC systems on the power network. However, the disclosure is not limited to HVAC applications of motors, compressors and all other significant HVAC loads, and explicitly contemplates controlling the operation of other significant electrical loads such as pumps, fans, refrigeration compressors, washing machines and driers.

Figure 1:
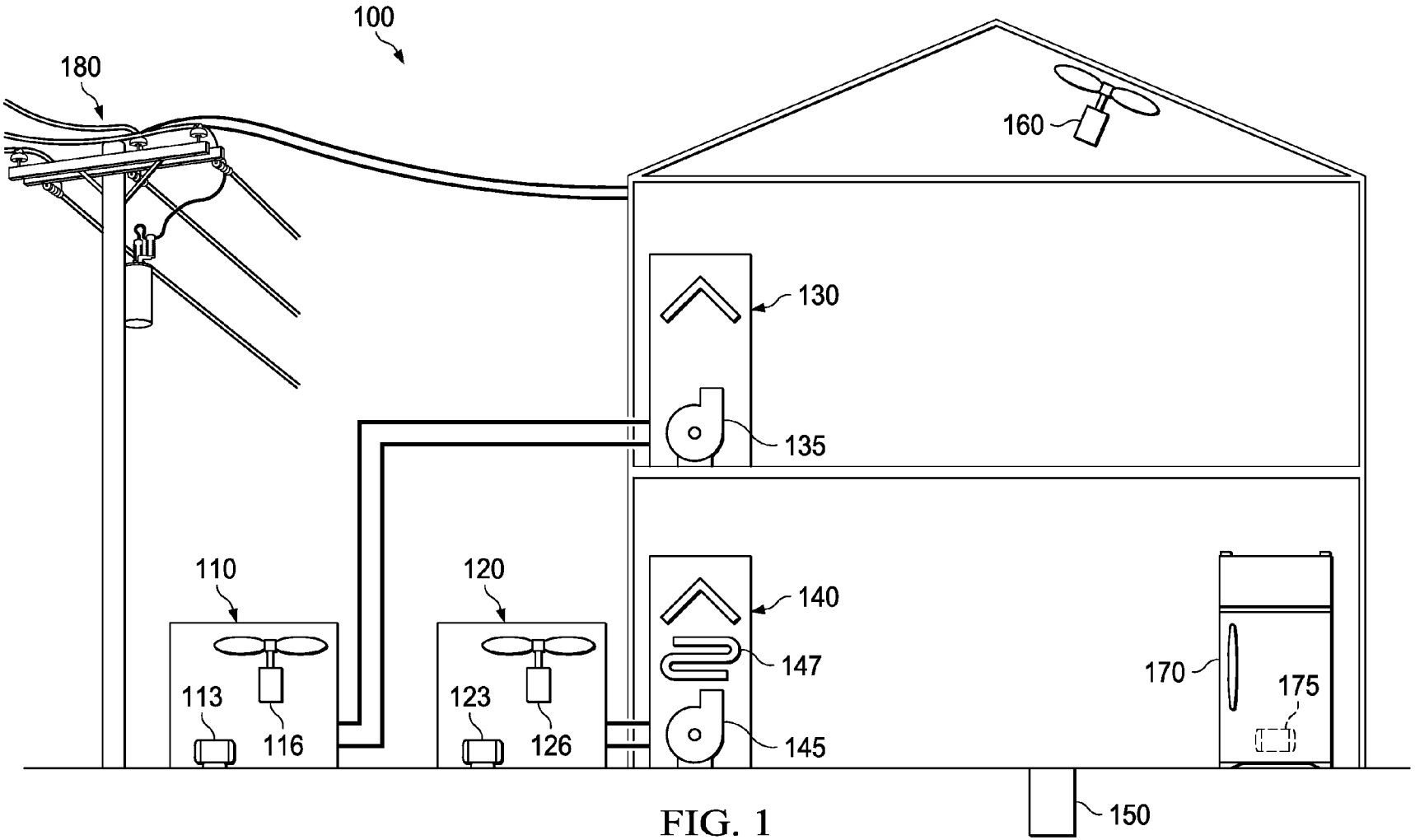
FIG. 1 illustrates a climate-controlled structure of the disclosure.

Turning initially to FIG. 1, a climate-controlled structure 100 is shown. As used herein, a climate-controlled structure is any structure, e.g. a residential, commercial or industrial building, that includes an HVAC system. The climate-controlled structure 100 includes various electrical loads. An outdoor HVAC unit 110 includes a compressor motor 113 and a fan motor 116. Similarly, an outdoor HVAC unit 120 includes a compressor motor 123 and a fan motor 126. The outdoor HVAC unit 110 operates with an associated indoor unit 130 that includes a fan motor 135. The outdoor HVAC unit 120 operates with an associated indoor unit 140 that includes a fan motor 145 and an electric furnace coil 147. The climate-controlled structure 100 also includes a sump pump motor 150, an attic fan motor 160, and a refrigerator 170 with an associated compressor motor 175.

FIG. 2 illustrates a motor assembly 200. The motor assembly 200 is representative of each of the compressor motors 113, 123, 175, the fan motors 116, 126, 135, 145, 160, and the pump motor 150, and may refer to such interchangeably when distinction between motors is not needed. Each instance of the motor assembly 200 includes an electric motor 210, and in some embodiments also includes a local load manager (LLM) 220. The LLM 220 may be configured to provide a communications link between each of the motors 210 within the structure 100 over which the motors 210 may coordinate their operation.

In some embodiments the LLM 220 includes or is integrated with functions of a conventional motor controller, e.g. a secondary relay to provide 120V or 240V to the motor 210. The motor 210 includes windings (not shown) that when energized produce magnetic fields that must be initially established when the motor 210 starts. The startup thus requires a startup current with a peak value greater than a rated operating load of the motor 210, expressed in horsepower or watts. The startup load imposed by the motor 210 is a typical characteristic of a type of load referred to herein as an inductive load. The furnace coil 147 may also act as an inductive load, thus requiring a peak startup current greater than an operating current. After the current is established in the motors 210 and/or the coil 147, the load is typically lower and constant, approximating a resistive load.

Returning to FIG. 1, each inductive load imposes an electrical load on a power distribution network 180. Without any constraint on the operation of the motors 210, any of the motors 210 is free to operate or start at any time. Thus, the total load on the power distribution network 180 must be designed to provide sufficient power to accommodate an expected aggregate peak demand that may include multiple simultaneous inductive loads. The need for the power distribution network 180 to provide this aggregate peak demand results in higher installation and maintenance costs associated with power distribution, and higher costs associated with backup production capacity such as for peak summer cooling demands.

To reduce the aggregate peak demand imposed by multiple motor assemblies 200 starting simultaneously, in one embodiment the LLMs 220 are configured to reduce the chance of simultaneous startup of multiple instances of the motor 210. Each motor assembly 200 may have an associated identification datum such as a serial number, a part number, a network address such as a media network address (MAC), an IP address or a serial bus device designator. Aspects of device identification are described, e.g., in U.S. patent application Ser. No. 12/603,526 (hereinafter the '526 Application), incorporated herein by reference.

In one embodiment the LLM 220 associated with one or more instances of the motor 210 is configured to derive a permitted start time from the identification datum. For example, the LLM 220 may be configured to perform a modulo computation to select a time within a fixed time period to start. For instance, the last digit of a serial number associated with the motor assembly 200 may be used to select a 10-minute interval of one hour to start. Thus, a LLM 220 with a serial number ending with a "1" may start at the $1^{st}$, $11^{th}$, . . . $51^{st}$ minute of the hour, a LLM 220 with a serial number ending with a "2" may start at the $2^{nd}$, $12^{th}$, . . . $52^{nd}$ minute of the hour, etc. Of course, the fixed time period may be any length desired. For instance, a 5 minute fixed time period may be divided into 30 s intervals. An internal clock, which may be optionally synchronized with a master clock, may provide a reference for the start time computed by the LLM 220.

In various embodiments, the permitted start time of one or more instances of the motor 210 may be determined by a system load manager, such as the SLM 700 described below, or a global load manger, such as the GLM 1060, also described below. In such embodiments, the load manager in question may communicate with the LLM 220 associated with the particular motor 210 to assert the permitted start time. In some cases the LLM 220 is replaced by a conventional motor controller. Communication may be by any of the means described with respect to the communication network 410 described below in the context of FIG. 4. Control by the SLM 700 or the GLM 1060 may be either continuous, or may be applied for bounded time periods. Thus, for example, the SLM 700 or the GLM 1060 may be configured to determine the start time of the one or more instances of the motor 210 under some conditions, such as a particular time range of a day, and to otherwise allow the LLM 220 associated with each instance of the motor 210 to determine the start time.

It is expected that the serial numbers of a plurality of motor assemblies 200 within the climate-controlled structure 100 will be randomly distributed, such that the probability is low that two or more motor assemblies 200 would have the same start time. However, it is also expected that overlapping start times will occur occasionally. In an embodiment the LLM 220 includes an adjustable offset. An installer may adjust the offset to move the start time of the motor assembly 200 by a number of minutes determined to eliminate overlap of the motor assembly 200 with any other motor assembly 200.

Moreover, when a large number of climate-controlled structures 100 are similarly configured, the start times of the associated motor assemblies 200 of the structures 100 is expected to be evenly distributed. Thus, the load imposed on the power distribution network 180 is expected to be more uniform than for the case of no randomization of the start times.

In some embodiments, the motor assembly 200 is configured to operate independently of other instances of the motor assembly 200 present in the structure 400. In other cases the LLM 220 is configured to communicate with another instance of the LLM 220. The LLM 220 of one instance of the motor assembly 200 may coordinate its operation with another instance of the motor assembly 200. For example, the LLM 220 may be configured to suppress operation of the motor 210 that would otherwise be permitted based on a time computation when the LLM 220 receives a signal indicating another instance of the motor 210 is currently operating. Coordination may be by any communication link, examples of which are described below.

FIG. 3 illustrates an embodiment 300 of operation of five instances of the motor assembly 200, designated motor assemblies 200*a*, 200*b*, 200*c*, 200*d*, 200*e*, collectively referred to as motor assemblies 200*a-e*, operating as described by the aforementioned embodiment. The operating state of each of the motor assemblies 200*a-e* is described as a logical level, with a high state of a particular motor assembly indicating that the associated motor 210 is operating, and a low state indicating that the associated motor 210 is idle. In the embodiment 300, the motor assemblies 200*a-e* are constrained to start at time increments of about one minute. No constraint is placed on the duty cycle or on-time of each motor assembly 200 in the illustrated embodiment. As few as zero and as many as four motor assemblies 200 operate simultaneously in the embodiment 300. However, none of the motor assemblies 200 simultaneously start, so overlapping inductive startup loads are advantageously avoided.

One advantage of this described embodiment 300 is that no communication between the motor assemblies 200 is required. Thus, the embodiment 300 may be implemented with relatively little cost. However, as illustrated in FIG. 3, any number of the motor assemblies 200 may simultaneously operate. In some cases, simultaneous operation of the motor assemblies 200 may be undesirable, as further reduction of the peak load may be desired.

Figure 4:
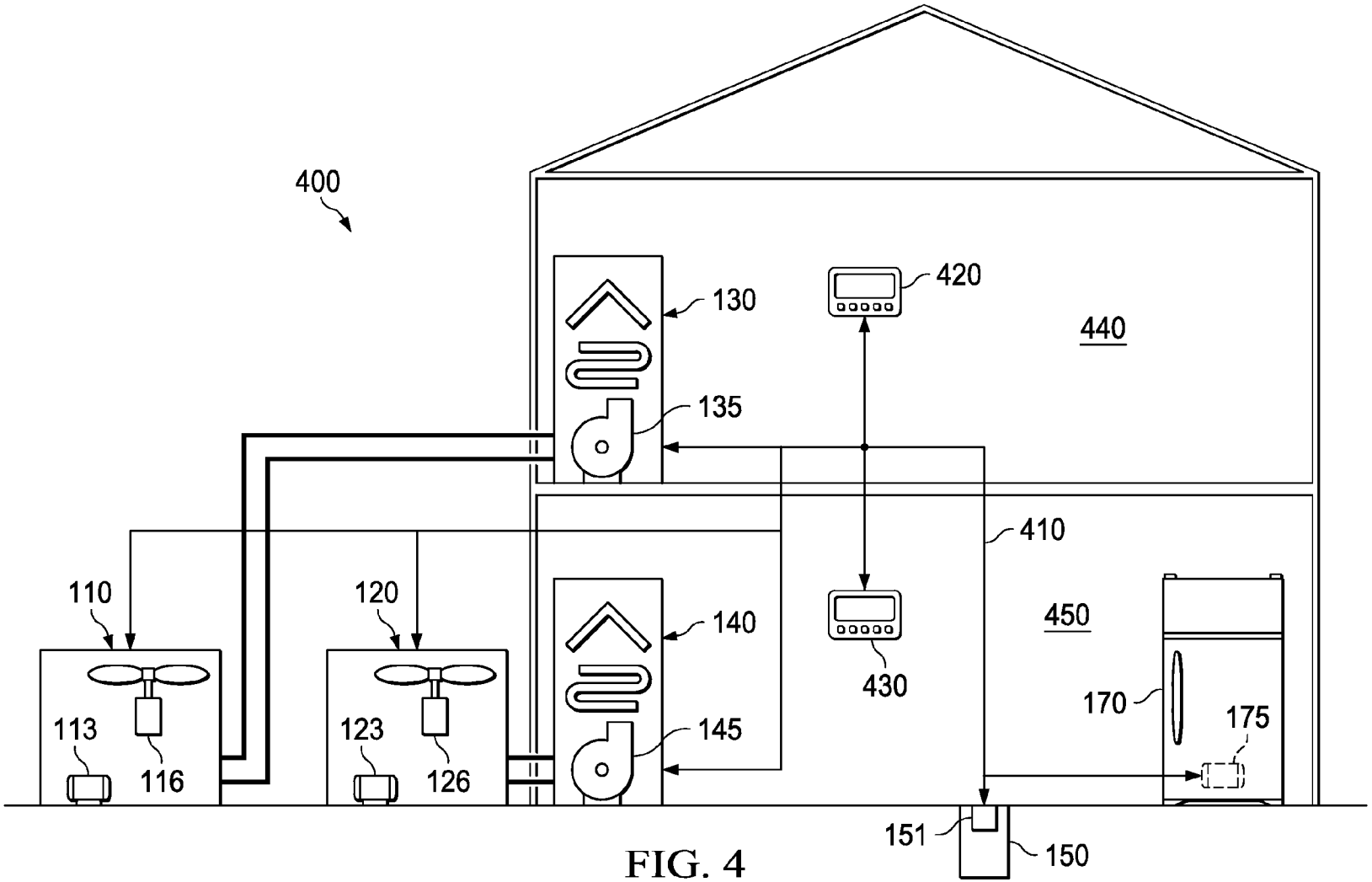
FIG. 4 illustrates a climate-controlled structure of the disclosure, in which LMs communicate via a communication network.

FIG. 4 illustrates an embodiment of a climate-controlled structure 400 in which the operation of a plurality of motors is coordinated. The structure 400 includes several of the components described with respect to FIG. 1, with like indexes referring to like components. In addition to the components previously described, the structure 400 includes a communication network 410. The communication network 410 interconnects the HVAC units 110, 120, the indoor units 130, 140, the pump motor 150, and the refrigerator 170. The communication network 410 also includes two controllers 420, 430.

The communication network 410 may be implemented by any conventional or novel wired or wireless communication standard or any combination of thereof. Without limitation, examples include the suite of communication standards commonly referred to as the "internet", wired or wireless LAN, or a serial bus conforming to the TIA/EIA-485 standard or the Bosch CAN (controller area network) standard. The controllers 420, 430 may include a processing capability, e.g. a memory and a processor. In some embodiments one or both controllers 420, 430 coordinate the operation of the several motors. In other embodiments one or more of the motors includes a communication and control capability, such as by the LLM 220.

In various embodiments the controllers 420, 430 and/or the LLMs 220 coordinate the operation of the motors 210 to restrict the number of motors 210 that simultaneously operate. For example, the motors 210 may be restricted such that only a single motor 210 may run at any given time. In another example, any number of motors 210 may simultaneously operate as long as the total load provided by the simultaneously operating motors 210 does not exceed a predetermined load, e.g. a total value of watts or horsepower. In some embodiments, the motors may be further restricted such that only one motor starts within a given time period to reduce cumulative inductive startup loads, as previously described.

In one embodiment, the controller 420 is configured to operate as a zone controller of a control zone 440. The controller 430 may also be configured to operate as a zone controller of a control zone 450. The controller 420 may control the operation of the outdoor HVAC unit 110 and the indoor unit 130 to maintain a temperature and/or humidity set-point within the control zone 440. The controller 430 may control the operation of the outdoor HVAC unit 120 and the indoor unit 140 to maintain a temperature and/or humidity set-point within the control zone 450. The controllers 420, 430 may also communicate via the communication network 410 to coordinate their operation such that the various motors within the HVAC units 110, 120 and the indoor units 130, 140 do not simultaneously operate and/or startup.

The controller 420 may optionally control only those motors 210 located within the control zone 440, e.g. the compressor motor 113, fan motor 116, and fan motor 135. By located within a control zone, it is meant that a motor is logically associated with that control zone. For instance, the compressor motor 113 is logically associated with the control zone 440 in that it provides a climate-control function directly to the control zone 440. In some cases, a particular motor 210 may be physically located within the control zone as well as logically located within the control zone.

In some embodiments the controller 420 may control motors 210 outside its control zone. For example, the controller 420 may control the compressor motor 113, which is logically located within the control zone 440, and the compressor motor 123, which is logically located within the control zone 450. The controller 420 may constrain the operation of the compressor motors 113, 123 such that they do not operate and/or start simultaneously.

In an embodiment, the pump motor 150 includes a LLM 151 that is configured to communicate via the communication network 410. In one embodiment the LLM 151 is configured to listen to control commands issued over the communication network 410, and to only operate when no other motor 210 connected to the communication network 410 is operating. The controllers 420, 430 and/or the motors 113, 116, 123, 126, 135, 145 may issue periodic messages via the communication network 410 to indicate their operational status. The LLM 151 may use such messages to coordinate its operation.

In some cases, the operation of the pump motor 150 may take precedence over the operation of other motors, such when a sump reservoir reaches its capacity. In some embodiments, the LLM 151 may issue an interrupt via the communication network 410. In response to an interrupt the other motors 210 cease operating until the pump motor 150 has completed its operation. In other embodiments, the pump motor 150 simply operates simultaneously with another motor in the event that nondiscretionary operation is required.

FIG. 5 illustrates an embodiment 500 that elucidates the operation of various motors 210 connected to the communication network 410. The motors 113, 116, 135 operate to maintain a temperature of the control zone 440. When the motors 113, 116, 135 are off, the control zone 440 temperature increases until it reaches an upper set point, e.g. at about 5:00. In an event sequence 510 the controller 420 turns on the compressor motor 113. After a short delay to accommodate the initial inductive load of the compressor motor 113, controller 420 turns on the fan motor 116. After a short delay to accommodate the initial inductive load of the fan motor 116, the controller 420 turns on the fan motor 135. Thus, none of the motors' inductive startup loads are simultaneously imposed on the power distribution network 180. In an event sequence 520 the motors 113, 116, 135 turn off without any restrictions on order.

Similarly, the motors 123, 126, 145 operate to maintain a temperature of the control zone 450. In an event sequence 530, the controller 430 turns on the motors 123, 126, 145 in response to the control zone 450 temperature reaching maximum set point. Again, there may be a delay between the start of the compressor motor 123 and the fan motor 126, and between the start of the fan motor 126 and the fan motor 145.

The LLM 151 may determine that no motors are running after the motors 113, 116, 135 turn off, e.g. the event sequence 520. Upon sensing the event sequence 520, the LLM 151 may operate the pump motor 150 as indicated by an event 540. In some cases the pump motor 150 may be operated preemptively. For example, when the pump motor 150 is a sump pump motor, the LLM 151 may operate the pump motor 150, even if the sump has not reached its capacity. In another example, the sump may reach capacity and require that the pump motor 150 operate to empty the sump. In an event sequence 550, the LLM 151 determines that one or more other motors are operating, e.g. the motors 123, 126, 145. The LLM 151 may issue an interrupt via the communication network 410, in response to which the controller 430 may turn off the motors 123, 126, 145. The LLM 151 may then turn on the pump motor 150. In this manner, the pump motor 150 is not operated simultaneously with the motors 123, 126, 145. After the pump motor 150 completes operation, the motors 123, 126, 145 may be restarted as before.

In another embodiment, the pump motor 150 is programmed to run immediately following the shutdown of the group of motors 123, 136 and 145. In some cases an HVAC system is configured to operate with a minimum off time for increased compressor reliability. In this embodiment the motor 150 operates during the minimum off time while the electrical loading on the power distribution network 180 is reduced. The LLM 151 may determine the relevant parameters of the minimum off time from configuration data of the communication network 410, or may be explicitly programmed with relevant parameters by a service technician when installed. Those skilled in the pertinent art will appreciate that the principles of operation described with respect to the LLM may be applied to other motors associated with the structure 400, such as the compressor motor 175.

FIG. 6 illustrates a climate-control system 600 represented schematically for reference in the following discussion. The climate-control system 600 includes four system controllers 608, 618, 628, 638. While shown separately, the controllers 608, 618, 628, 638 are not limited to any particular embodiment. For instance, the controllers 608, 618, 628, 638 may be functional portions of a single physical unit. The controllers 608, 618, 628, 638 provide respective command signals 610, 620, 630, 640 to control respective HVAC systems 612, 622, 632, 642. The controllers 608, 618, 628, 638 are logically associated in that each coordinates its operation with the others via a communication network 650. The operation of the controllers 608, 618, 628, 638 may be coordinated with controllers of another instance of the climate-control system 600, but need not be. Each of the HVAC systems 612, 622, 632, 642 may be responsible for maintaining the temperature of an associated climate-control area (or zone) 615, 625, 635, 645. In some cases a single controller, e.g., the controller 608, controls the operation of multiple HVAC systems, e.g. the HVAC systems 612, 622.

Turning briefly to FIG. 7, an illustrative embodiment of a system load manager (SLM) 700 is presented. The SLM 700 is representative of some embodiments of one or more of the controllers 420, 430, 608, 618, 628, 638. The SLM 700 may include a processor 710, a memory 720 and a communications interface 730. The configuration of the processor 710, memory 720 and communications interface 730 may be conventional or novel. An example embodiment of such a controller is described, e.g. in the '526 Application. Briefly, the processor 710 reads stored instructions from the memory 720. The instructions configure the processor 710 to perform its control functions, including coordinating operation with other instances of the SLM 700 that may be present on a communication network 740. The communication network 740 may connect to, e.g. the communication network 410 (FIG. 4). Those skilled in the pertinent art are capable of determining specific design aspects of the SLM 700 to implement the various embodiments of the disclosure.

FIG. 8 illustrates an embodiment in which the SLM 700 is located in an enclosure 810 with a user interface 820 and an environmental sensor 830. Such an enclosure is described here briefly and in greater detail in the '526 Application. The user interface 820 may be, e.g. a panel or touch screen configured to accept user input and display system information. The environmental sensor 830 may be, e.g. a temperature or relative humidity sensor. The SLM 700, user interface 820 and environmental sensor 830 are configured to communicate with each other and with other networked devices over a communication network 840. The communication network 840 may connect to, e.g. the communication network 410 (FIG. 4).

The operation of the controllers 608, 618, 628, 638 may be coordinated in one or more of the following embodiments. FIG. 9 represents the operation of each of the HVAC systems 612, 622, 632, 642 by a logical status of the command signals 610, 620, 630, 640. In a first embodiment, the HVAC systems 612, 622, 632, 642 are restricted from simultaneously starting, but may otherwise simultaneously operate. Thus, any number of the HVAC systems 612, 622, 632, 642 may simultaneously operate. In an alternate embodiment, operation of the HVAC systems 612, 622, 632, 642 may be constrained such that a proper subset of the HVAC systems 612, 622, 632, 642 may simultaneously operate. FIG. 9, for example, illustrates an embodiment in which only two of the HVAC systems 612, 622, 632, 642 may simultaneously operate.

In some embodiments, the proper subset is a single one of the HVAC systems 612, 622, 632, 642. Thus simultaneous operation of the HVAC systems 612, 622, 632, 642 is prohibited in this case. In some embodiments, each of the HVAC systems 612, 622, 632, 642 may be permitted to operate until its load demand is satisfied, i.e. the temperature of the associated zone 615, 625, 635, 645 is reduced below a temperature set-point. In such an embodiment the controllers 608, 618, 628, 638 may coordinate their operation, e.g. by passing a token. For example, when the zone 615 reaches its set-point, the controller 608 may pass a token to the controller 618 via the communication network 650. Receipt of the token allows the controller 618 to operate to cool the zone 625.

In another embodiment, a subset of the HVAC systems 612, 622, 632, 642 includes at least two of the HVAC systems 612, 622, 632, 642, and may include all of the HVAC systems 612, 622, 632, 642. In this embodiment the subset of systems is constrained such that run time is allocated among the subset of the HVAC systems 612, 622, 632, 642 according to allocation rules. Allocation rules may include, e.g. restrictions on a total number of simultaneously operating HVAC systems 612, 622, 632, 642, a total instantaneous power consumption, or a maximum permissible temperature excursion of a zone 615, 625, 635, 645.

In one embodiment the allocation rules include running one or more of the HVAC systems 612, 622, 632, 642 for a minimum on-time. In another embodiment the allocation rules further include idling one or more of the HVAC systems 612, 622, 632, 642 for a minimum off-time. Such allocation rules may protect various HVAC components from damage, e.g. the compressors associated with the compressor motors 113, 123.

In one embodiment the allocation rules include providing sufficient run time to each HVAC system 612, 622, 632, 642 such that each HVAC system 612, 622, 632, 642 is able to maintain the temperature of its associated zone 615, 625, 635, 645. If a particular zone, e.g. the zone 615 is subject to a cooling demand greater than the other zones 625, 635, 645, then the zone 615 is given priority over the other zones 625, 635, 645. In some cases priority may include allowing the HVAC system 612 to operate without interruption until the zone 615 temperature falls below a maximum permissible value. In other cases, the zone 615 may be allowed to operate longer than the other zones. Thus, if each HVAC system 612, 622, 632, 642 was initially allowed to operate for 25% of a unit time period (e.g. 15 minutes of each hour), when the zone 615 has priority the HVAC system 612 may be permitted to operate for 40% of the unit time period, while the HVAC systems 622, 632, 642 may be allowed to operate only for 20% of the unit time period. The priority may be removed when the additional load on the zone 615 ends. Priority may be assigned to any other zones 625, 635, 645 if that zone experiences increased load.

In some cases the aggregate cooling demand on the climate-control system 600 may exceed the ability of the HVAC systems 612, 622, 632, 642 to maintain a desired temperature set-point. In an embodiment, the controllers 608, 618, 628, 638 are configured to allow the temperature of the associated zone 615, 625, 635, 645 to rise above the temperature set-point. The controllers 608, 618, 628, 638 may coordinate with each other such that each zone 615, 625, 635, 645 experiences the same temperature excursion, e.g. 2° above a nominal maximum temperature set-point.

In another embodiment each zone 615, 625, 635, 645 may be assigned a priority. A zone 615, 625, 635, 645 with a higher priority may be permitted to satisfy its cooling demand before a zone 615, 625, 635, 645 with a lower priority is permitted to operate. In a variation on this embodiment, a zone 615, 625, 635, 645 with a higher priority may be permitted to operate for a longer period, or for a larger part of a unit time, than a zone 615, 625, 635, 645 with a lower priority. In some embodiments the priority of a particular zone may be promoted or demoted based on, e.g. user input or the occurrence of an event. Examples of events include the occurrence of a time of day, week or month, a request received from a controller associated with another zone, or the receipt of a command signal from a global controller, as discussed below.

Turning to FIG. 10, illustrated is an embodiment generally designated 1000 of coordinating operation of a plurality of motors 210. A cluster 1010 of climate-controlled structures 1020 is connected by a communication network 1030. The structures 1020 may be, e.g. residential, industrial or commercial buildings. While the disclosure is not limited to any particular number, it is contemplated that in some cases the cluster 1010 may include about 100 of the structures 1020. It is contemplated that in some cases the structures 1020 are physically associated, such as homes in a neighborhood or subdivision. In another aspect, the structures 1020 are associated by their relationship to a power distribution grid 1040. For example, each of the structures 1020 may share a connection to a common power substation 1050. The communication network 1030 may be any wired or wireless network, or a mixture of wired and wireless. For example, the communication network 1030 may include elements of a cable television network, fiber optical network, digital subscriber line (DSL) network, telephone network, utility metering network and/or wireless local area network (LAN).

Each of the structures 1020 includes at least one control zone, such as the control zone 440, and a controller such as the SLM 700. Without limitation the following description of the operation of the cluster 1010 refers to the SLM 700 and the control zone 440.

The SLM 700 is configured to communicate with other instances of the SLM 700 present on the communication network 1030. In some embodiments, as illustrated, the cluster 1010 includes a demand server, or global load manager (GLM), 1060 that communicates with the SLMs 700 to provide overall management of the cluster 1010 or to augment the control functions of the SLMs 700. The GLM 1060 may include various components, such as a processor, scratch memory, disk drive and network interface. In various embodiments the GLM 1060 may operate as a master controller with respect to motors 210 within the cluster 1010. In some embodiments the GLM 1060 communicates with an electrical distribution grid control server (not shown) that provides high-level operating constraints, such as a maximum power the cluster 1010 is permitted to consume for HVAC purposes. Such a maximum may vary seasonally or by time of day.

The SLMs 700 and/or the GLM 1060 cooperate to limit the occasions in which HVAC motors or other motors within the structures 1020 simultaneously start, thereby reducing inductive load spikes presented by the cluster 1010 to the power distribution grid 1040. The instances of the SLM 700 may communicate to manage the power load presented by the cluster 1010 to the power distribution grid. Aspects of the various embodiments already described may be applied at the scale of the cluster 1010 to reduce the peak power demand of the cluster 1010, and to generally reduce fluctuations of the power consumed by the cluster 1010.

In yet another embodiment the SLM 700 is configured to act as the GLM 1060. Any one of a plurality of SLMs 700 connected to the control cluster 1010 may act as the GLM 1060. In such an embodiment, the SLM 700 may include an arbitration routine that enables each SLM 700 in the plurality to choose one particular SLM 700 to act as the GLM 1060. Such arbitration may take into account, e.g. manufacturing date, configuration options or revision level of the plurality of SLMs 700.

In some embodiments the GLM 1060 controls operation of HVAC operation within one or more of the structures 1020 based on particular events or rules. In one example, a target temperature of a particular structure 1020 may be set depending on a contracted price per unit of power delivered to that structure 1020. In another example, a target temperature for a particular structure 1020 may be set higher in the summer, or lower in the winter when a utility customer falls behind in bill payment. In another example, a utility customer or agent acting for the customer may access the GLM 1060 via a telephone or internet connection, or the communication network 1030, and change a target temperature for a particular structure 1020.

In various embodiments, the LLM 220, SLM 700 and/or GLM 1060 is configured to instruct the motor 210 to operate a fraction less than 100% of a maximum capacity. FIGS. 11A and 11B illustrate two sets of generalized command signals to illustrate this embodiment. FIG. 11A illustrates the operation of two instances of the motor 210, a motor 210*a* and a motor 210*b*. The motor 210*a* begins operation at 100% of its maximum capacity, operates for a time, and ends operation. Then the motor 210*b* begins operation at 100% of its maximum capacity, operates for a time and ends operation. While either the motor 210*a* or the motor 210*b* is operating, the power distribution grid provides 100% of the maximum capacity of the operating motor 210.

FIG. 11B illustrates the motor 210*a* operating at 50% of its rated maximum capacity, and motor 210*b* operating at 50% of its rated maximum capacity. Thus, when the motors 210*a*, 210*b* are operating the power distribution grid see no more load than required by 100% of the maximum capacity of one or the other of the motors 210*a*, 210*b*. Illustratively, the motor 210*b* begins operation a short time after the motor 210*a* to avoid simultaneous inductive startup loads on the power distribution grid. One skilled in the art will appreciate that the illustrated principles may be extended to more than two motors, and any fraction of maximum capacity.

Those skilled in the pertinent art will appreciate that the principles described herein may be applied to other constrained-demand utilities, such as natural gas distribution. Focusing on natural gas distribution, without limitation, various loads may be imposed on the gas distribution by a furnace, a hot water heater, gas stove, or a gas dryer. Each may be equipped with a local gas load monitor. Gas load monitors may be coordinate with each other or with a system gas load monitor or a global gas load monitor to constrain the operation of the various gas loads to meet a desired condition, e.g. a maximum peak gas load as seen by the natural gas distribution system. Similar benefits may result as described with respect to electrical distribution, e.g. lower costs associated with lower peak gas demand on a system, subdivision or household basis.

FIG. 12A illustrates a method 1200 for manufacturing a load manager of the disclosure. The method 1200 is described without limitation with reference to elements of FIG. 7.

In a step 1210 a memory, e.g. the memory 720, is configured to store controller instructions. In a step 1220 a communications interface, e.g. the communications interface 730, is adapted to transmit motor command signals to a first and a second electric motor, e.g. the compressor motors 113, 123. In a step 1230, a processor, e.g. the processor 710 is configured to issue the motor command signals in response to the controller instructions. The motor command signals are configured to prevent the compressor motors 113, 123 from simultaneously starting.

FIG. 12B presents optional steps of the method 1200. In a step 1240 the processor 710 is located in the enclosure 810 with at least one of the user interface 820 and the environmental sensor 830. In a step 1250 the processor is configured to communicate with a second processor located within a second climate-controlled structure and to control operation of the first electric motor in response to an instruction received from the second processor.

Those skilled in the art to which this application relates will appreciate that other and further additions, deletions, substitutions and modifications may be made to the described embodiments.

What is claimed is:

1. An HVAC system, comprising:

a first electric motor having a first maximum capacity and a second electric motor having a second maximum capacity; and a load manager coupled to said first electric motor, said load manager configured to selectively:

prevent said first electric motor from operating simultaneously with said second electric motor by:

determining that a first control zone associated with said first electric motor has reached a set-point temperature, said first control zone associated with a first climate-controlled structure; and in response to determining that said first control zone associated with said first electric motor has reached said set-point temperature:

stopping said first electric motor from operating; and transmitting a token to said second electric motor, wherein said token allows said second electric motor to operate; and instruct said first electric motor and said second electric motor to simultaneously operate with said first electric motor operating at less than 100% of said first maximum capacity and said second electric motor operating at less than 100% of said second maximum capacity, wherein a total simultaneous operating capacity created by operation of said first electric motor and operation of said second electric motor is less than one of either said first maximum capacity or said second maximum capacity.

2. The HVAC system of claim 1, wherein simultaneously operating includes simultaneously starting.

3. The HVAC system of claim 1, wherein said load manager assigns a time slot to said first electric motor to start based on an identification datum of said first electric motor.

4. The HVAC system of claim 1, wherein said load manager is configured to communicate with said first electric motor via a communication network.

5. The HVAC system of claim 1, wherein said second electric motor is located within a second control zone of said first climate-controlled structure, said first control zone and said second control zone being different.

6. The HVAC system of claim 1, wherein said second electric motor is located in a second detached climate-controlled structure, said first climate-controlled structure and said second detached climate-controlled structure being different.

7. The HVAC system of claim 6, wherein said load manager is a demand server configured to coordinate the operation of electric motors located in a plurality of detached climate-controlled structures.

8. An HVAC load manager, comprising:

a memory configured to store controller instructions;

a communications interface adapted to transmit motor command signals to a first electric motor having a first maximum operating capacity and a second electric motor having a second maximum operating capacity; and a processor configured to issue said motor command signals in response to said controller instructions, said motor command signals selectively including:

first signals being configured to prevent said first electric motor and said second electric motor from simultaneously operating by:

determining that a first control zone associated with said first electric motor has reached a set-point temperature, said first control zone associated with a first climate-controlled structure; and in response to determining that said first control zone associated with said first electric motor has reached said set-point temperature:

stopping said first electric motor from operating; and transmitting a token to said second electric motor, wherein said token allows the second electric motor to operate; and second signals being configured to instruct said first electric motor and said second electric motor to simultaneously operate with said first electric motor operating at less than 100% of said first maximum capacity and said second electric motor operating at less than 100% of said second maximum capacity, wherein a total simultaneous operating capacity created by operation of said first electric motor and operation of said second electric motor is less than one of either said first maximum capacity or said second maximum capacity.

9. The HVAC load manager as recited in claim 8, wherein said processor prevents said first electric motor and said second electric motor from simultaneously starting.

10. The HVAC load manager as recited in claim 8, wherein said second electric motor is logically associated with a second control zone of said first climate-controlled structure, said first control zone and said second control zone being different, and said processor controls said first electric motor and said second electric motor to maintain a same temperature difference from said set-point temperature for each of said first control zone and said second control zone.

11. The HVAC load manager as recited in claim 8, wherein said processor controls said first electric motor to satisfy a first load demand for said first control zone of said first climate-controlled structure, and then said second electric motor is controlled to satisfy a second load demand for a second control zone of said first climate-controlled structure.

12. The HVAC load manager as recited in claim 8, wherein said first electric motor has an associated first priority, and said second electric motor has an associated second priority, said second priority being lower than said first priority, and said motor command signals are configured such that said first electric motor satisfies a first load demand before said second electric motor satisfies a second load demand.

13. The HVAC load manager as recited in claim 8, wherein said second electric motor is located in a second detached climate-controlled structure, said first climate-controlled structure and said second detached climate-controlled structure being different.

14. The HVAC load manager as recited in claim 13, wherein said processor is configured to communicate with a second processor located within said second detached climate-controlled structure and to control operation of said first electric motor in response to an instruction received from said second processor.

15. A method of manufacturing an HVAC load manager, comprising:

configuring a memory to store controller instructions;

adapting a communications interface to transmit motor command signals to a first electric motor having a first maximum capacity and a second electric motor having a second maximum operating capacity; and configuring a processor to issue said motor command signals in response to said controller instructions, said motor command signals being configured to selectively:

prevent said first electric motor from operating simultaneously with said second electric motor by:

determining that a first control zone associated with said first electric motor has reached a set-point temperature, said first control zone associated with a first climate-controlled structure; and in response to determining that said first control zone associated with said first electric motor has reached said set-point temperature:

stopping said first electric motor from operation; and transmitting a token to said second electric motor, wherein said token allows said second electric motor to operate; and instruct said first electric motor and said second electric motor to simultaneously operate with said first electric motor operating at less than 100% of said first maximum capacity and said second electric motor operating at less than 100% of said second maximum capacity, wherein a total simultaneous operating capacity created by operation of said first electric motor and operation of said second electric motors is less than one of either said first maximum capacity or said second maximum capacity.

16. The method as recited in claim 15, wherein said processor prevents said first electric motor and said second electric motor from simultaneously starting.

17. The method as recited in claim 15, wherein said second electric motor is logically associated with a second control zone of said first climate-controlled structure, said first control zone and said second control zone being different, and said processor controls said first electric motor and said second electric motor to maintain a same temperature set-point excursion for each of said first control zone and said second control zone.

18. The method as recited in claim 15, wherein said processor is configured to control said first electric motor to satisfy a first load demand for said first control zone of said first climate-controlled structure, and then said second electric motor is controlled to satisfy a second load demand for a second control zone of said first climate-controlled structure.

19. The method as recited in claim 15, wherein said first electric motor has an associated first priority, and said second electric motor has an associated second priority, said second priority being lower than said first priority, and said motor command signals are configured such that said first electric motor satisfies a first load demand before said second electric motor satisfies a second load demand.

20. The method as recited in claim 17, wherein said second electric motor is located in a second climate-controlled structure, said first detached climate-controlled structure and said second detached climate-controlled structure being different.

21. The HVAC system of claim 1, wherein said load manager is a first load manager physically collocated with and coupled to said first electric motor, and further comprising a second load manager physically collocated with and coupled to said second electric motor, said second load manager configured to cooperate with said first load manager to manage operation of said first electric motor and said second electric motor.

22. The HVAC system of claim 1, wherein said first electric motor has an HVAC role, and said second electric motor has no HVAC role.

23. An HVAC system, comprising:

a first electric motor;

a second electric motor; and a load manager coupled to said first electric motor, said load manager configured to prevent said first electric motor from operating simultaneously with said second electric motor by:

determining that a first control zone associated with said first electric motor has reached a set-point temperature, said first control zone associated with a first climate-controlled structure; and in response to determining that said first control zone associated with said first electric motor has reached said set-point temperature:

stopping said first electric motor from operating; and transmitting a token to said second electric motor, wherein said token allows said second electric motor to operate; and wherein said second electric motor is located in a second detached climate-controlled structure, said first climate-controlled structure and said second detached climate-controlled structure being different.

24. The HVAC system of claim 23, wherein said first electric motor has an HVAC role, and said second electric motor has no HVAC role.

25. The HVAC load manager of claim 8, wherein said first electric motor has an HVAC role, and said second electric motor has no HVAC role.

26. The method of claim 15, wherein said first electric motor has an HVAC role, and said second electric motor has no HVAC role.

* * * * *